US006336829B2

(12) United States Patent
Matsukawa

(10) Patent No.: US 6,336,829 B2
(45) **Date of Patent: *Jan. 8, 2002**

(54) ELECTRICAL CONNECTOR FREE FROM SOLDERING CONTAMINATION

(75) Inventor: Jun Matsukawa, Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/414,715

(22) Filed: Oct. 12, 1999

(30) Foreign Application Priority Data

Oct. 20, 1998 (JP) ..... 10-297857

(51) Int. Cl.[7] ..... H01R 24/00

(52) U.S. Cl. ..... 439/660; 439/83; 439/636; 439/876; 439/884

(58) Field of Search ..... 439/660, 884, 439/74, 636, 662, 637, 83, 576

(56) References Cited

U.S. PATENT DOCUMENTS 4,306,761 A * 12/1981 Ress, Jr. ..... 339/252
5,192,232 A 3/1993 William
5,338,231 A * 8/1994 Wilhite ..... 439/660
5,746,626 A * 5/1998 Kwiat et al. ..... 439/630
5,762,505 A * 6/1998 Lin ..... 439/83
5,975,916 A * 11/1999 Okura ..... 439/74
6,036,504 A * 3/2000 McHugh et al. ..... 439/74

FOREIGN PATENT DOCUMENTS

WO WO 97/04505 2/1997

* cited by examiner

*Primary Examiner*—Paula Bradley
*Assistant Examiner*—Truc Nguyen
(74) *Attorney, Agent, or Firm*—Kanesaka & Takeuchi

(57) ABSTRACT

An electrical connector comprises an elongated connector body (1) having a plug cavity (2) for receiving a mating connector; a plurality of partition walls (8) provided within the plug cavity (2) with a predetermined pitch to form a plurality of terminal mounting spaces (9); a plurality of contact terminals (12) each having a fixing section (13), a terminal lead (14) extending from one end of the fixing section, a U-shaped section (15) extending from the other end of the fixing section, and a contact section (16) extending from the U-shaped section. The fixing sections are mounted in the terminal mounting spaces such that the terminal leads projecting from the connector body and the contact sections facing a center of the plug cavity; and a device for preventing the contact sections from moving toward the fixing sections. Protrusions (11) are provided on sides of the partition walls (8) enter the gaps (17) between the contact sections (16) and the fixing sections (13).

2 Claims, 5 Drawing Sheets

ELECTRICAL CONNECTOR FREE FROM SOLDERING CONTAMINATION

BACKGROUND OF THE INVENTION

1. Field of the Invention

The present invention relates to electrical connector to be mounted on a printed circuit board (PCB).

2. Field of the Invention

Japanese patent application Kokai No. 6-310197 discloses an electrical connector of this type. As shown in FIG. 7, a contact terminal 40 has a fixing section 41, a contact section 42 extending downwardly from the fixing section 41, and a terminal lead 43 extending laterally from the fixing section 41. It is mounted over the side walls 44 and 45 of a plug cavity 47 of a connector body 46 such that the contact sections 42 are exposed within the plug cavity while the fixing sections 41 and the terminal leads 43 are outside of the plug cavity 47.

In order to prevent movement of the contact sections 42, the terminal leads 43 and fixing sections 41 are placed on the outside of the side walls 44 and 45 while the contact sections 42 are placed on the insides of the side walls 44 and 45 so that capillary effects are produced to pull the flux from the mounting area to the contact sections 42, making unstable contact conditions.

SUMMARY OF THE INVENTION

Accordingly, it is an object of the invention to provide an electrical connector able to prevent the flux and solder from climbing from the mounting area on a PCB, thereby providing stable contact conditions.

According to the invention there is provided an electrical connector comprising an elongated connector body having a plug cavity for receiving a mating connector; a plurality of terminal mounting spaces provided within the plug cavity with a predetermined pitch in a longitudinal direction of the connector body; a plurality of contact terminals each having a fixing section, a terminal lead extending from one end of the fixing section, a U-shaped section extending from the other end of the fixing section, and a contact section extending from the U-shaped section; the fixing sections being mounted in the terminal mounting spaces such that the terminal leads projecting from the connector body and the contact sections facing a center of the plug cavity; and a device for preventing the contact sections from moving toward the fixing sections.

The terminal length between the contact section and the fixing section is large, the contact section is connected to the fixing section via the U-shaped section, the device for preventing the contact section from moving toward the fixing section and keeping it from the side wall to avoid the capillary effects thereby preventing the flux and solder from climbing from the mounting area on the PCB.

According to an embodiment of the invention there is provided an electrical connector comprising a plurality of partition walls to form the terminal mounting spaces with the pitch in the longitudinal direction; and the device comprises protrusions which are provided on sides of the partition walls and enter gaps between the contact sections and the fixing sections of the contact terminals.

The protrusions enter the gaps between the contact sections and the fixing sections to prevent the contact sections from moving toward the fixing sections and keep the contact sections from the side walls, thereby preventing the capillary effects and the flux and solder from climbing from the mounting area on the PCB, thus providing a stable contact.

According to another embodiment of the invention, the device comprises an inward edge extending laterally from the contact section toward the fixing section.

The inward edge prevents the contact section from moving toward the fixing section and keeping the contact section from the side wall, thereby avoiding the capillary effects to prevent the flux and solder from climbing from the mounting area on the PCB, providing a stable contact.

DESCRIPTION OF THE PREFERRED EMBODIMENTS

Embodiments of the invention will now be described with reference to the accompanying drawings.

First Embodiment

Figure 1A:
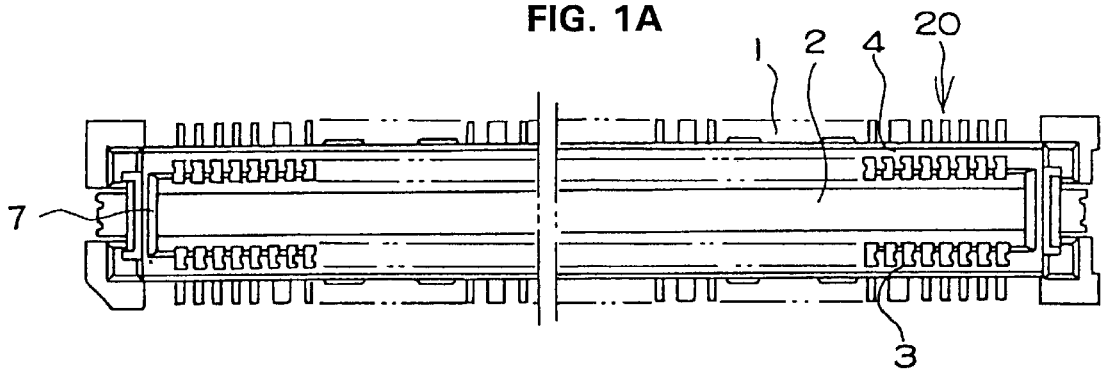
FIG. 1A is a top plan view of a receptacle connector according to an embodiment of the invention.
Figure 1B:
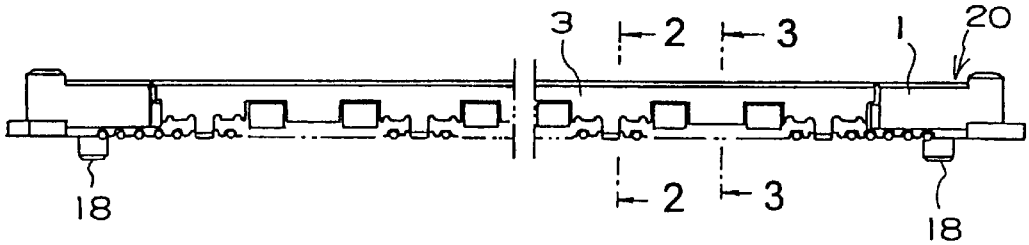
FIG. 1B is a side elevational view of the receptacle connector.
Figure 2:
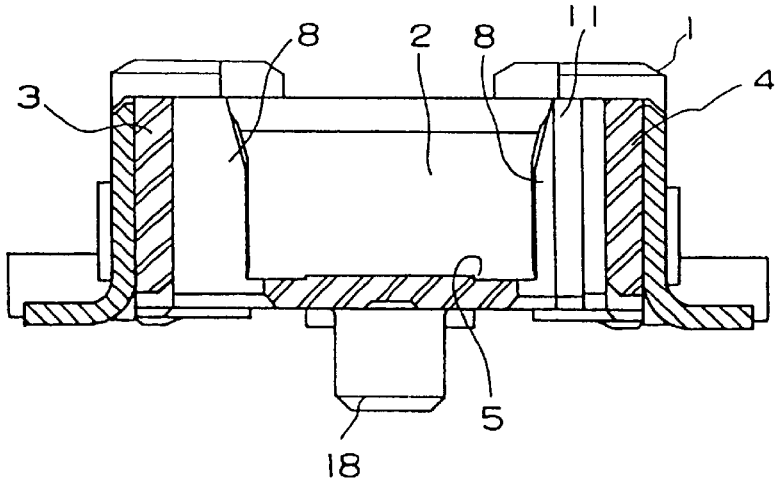
FIG. 2 is a sectional view taken along line 2—2 of FIG. 1B.

An electrical connector according to the first embodiment of the invention is shown in FIGS. 1A and 1B, and 2.

A receptacle connector 20 comprises an elongated connector body 1 with a mating connector plug cavity 2 having terminal mounting spaces 9 and a plurality of contact terminals 12 mounted on the terminal mounting spaces 9.

The plug cavity 2 extends downwardly from the top face of and along the length of the connector body 1 and has left and right side walls 3 and 4, a bottom wall 5, and front and rear walls 6 and 7.

A plurality of partition walls 8 extend inwardly from the left and right side walls 3 and 4 with a predetermined pitch along the length of the connector body 1 to form the terminal mounting spaces 9. A plurality of terminal apertures 10 extends through the bottom wall 5 of the terminal mounting spaces 9 and the lower ends of the left and right side walls 3 and 4. A pair of protrusions 11 extend vertically on the front and back sides 8*b* and 8*a* of each partition wall 8 but they are spaced from the printed circuit board 19.

Figure 3:
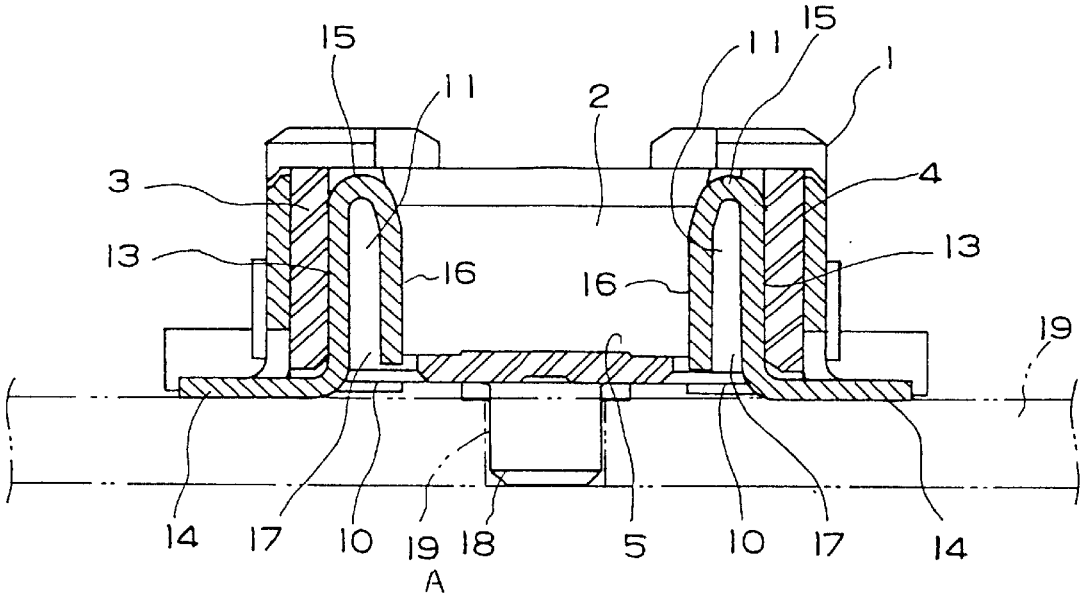
FIG. 3 is a sectional view taken along line 3—3 of FIG. 1B.
Figure 4:
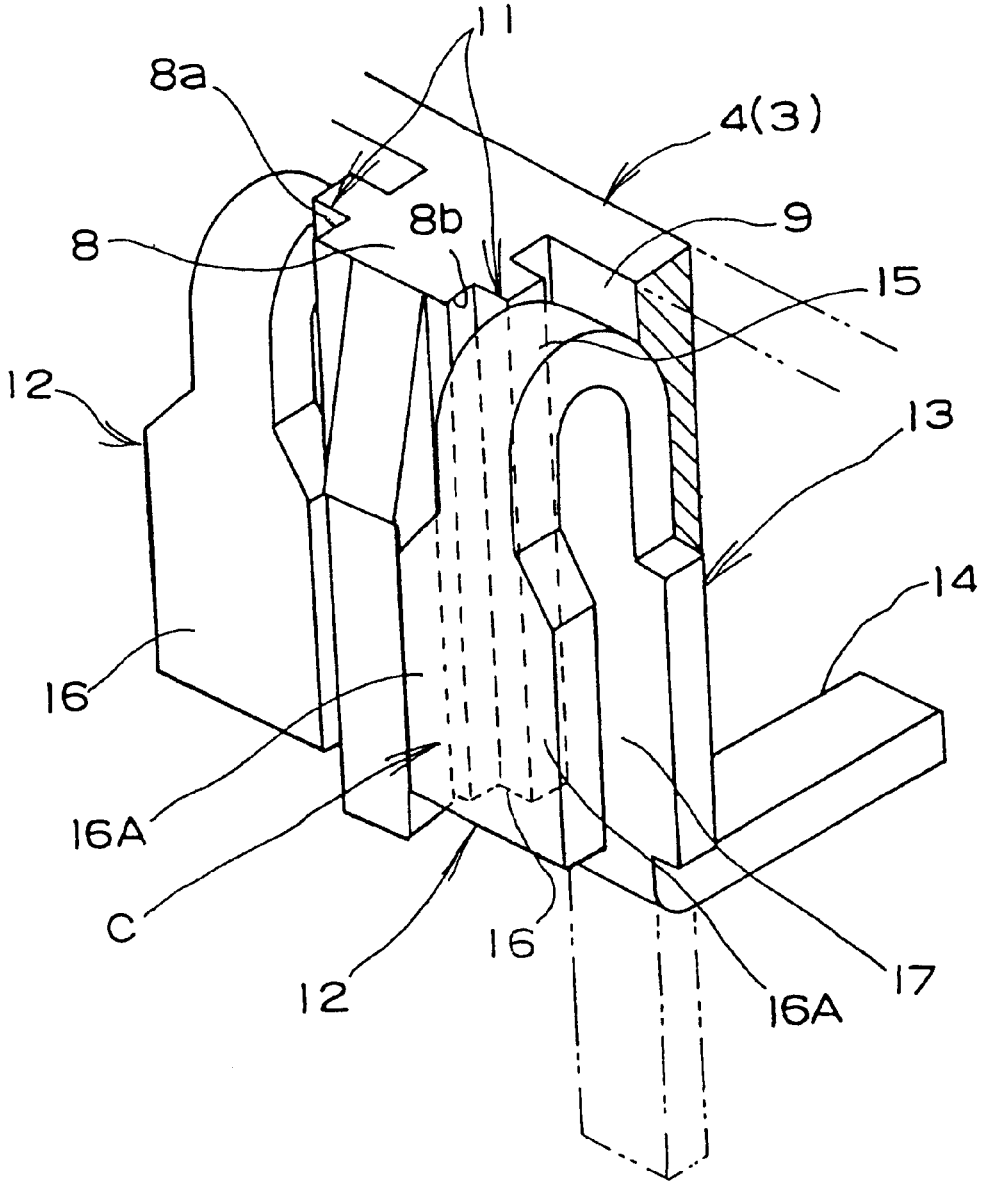
FIG. 4 is a perspective view of contact terminals mounted in the receptacle connector.
Figure 5:
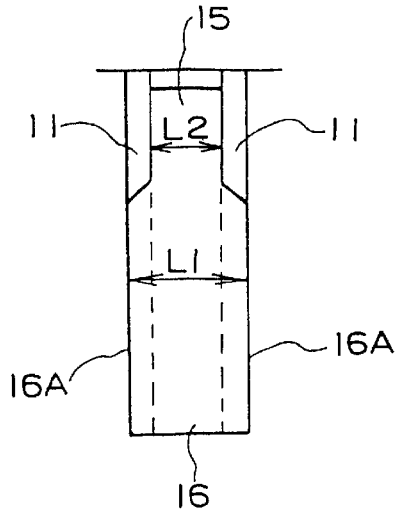
FIG. 5 is an elevational view of the contact terminal viewed from an arrow C of FIG. 4.

As shown in FIGS. 3 and 4, the contact terminal 12 has a fixing or press-fit section 13, a terminal lead 14 extending laterally from the press-fit section 13, a linking or U-shaped section 15 extending upwardly and then downwardly from the press-fit section 13, and a contact section 16 extending downwardly from the linking section 15 and is parallel to the press-fit section 13 with a gap 17. The width L1 of the contact section 16 is greater than the width L2 of the linking section 15. The width of each extended side 16A is (L1−L2)/2.

The contact terminal 12 is mounted in the terminal mounting space 9 through the terminal aperture 10 by inserting the press-fit section 13 into the terminal mounting space between the partition walls 8 such that the terminal lead 14 projects from the terminal aperture 10 and the contact section 16 faces the center of the plug cavity 2. The protrusions 11 on the front and rear sides 8*a* and 8*b* of the partition wall 8 are inserted in the gap 17 between the contact section 16 and the press-fit section 13. The extended sides 16A of the contact section 16 abut against the protrusions 11 to prevent the contact section 16 from moving toward the press-fit section 13.

The receptacle connector 20 is mounted on a printed circuit board 19 by inserting a positioning pin 18 into a positioning hole 19A such that the terminal leads 14 of the respective contact terminals 12 are brought into contact with solder cream on the contact pattern of the PCB 19 and the terminal leads 14 are soldered by reflow to the contact pattern.

By plugging a mating plug connector into the receptacle connector 20, the contact terminals of the plug connector are brought into contact with the respective contact terminals 12 of the receptacle connector 20.

The contact sections 16 of the contact terminals 12 are pressed by the contact sections of the plug connector toward the press-fit sections 13 but unable to move toward the press-fit sections 13 because the extended sides 16A abut against the protrusions 11.

Since the press-fit section 13 and the contact section 16 of the contact terminal 12 are not exposed from the plug cavity 2 owing to the left and right side walls 3 and 4, the adjacent contact terminals mounted on the PCB 19 are not short-circuited by a conductive foreign object, such as dirt and dust, attached to the outer side faces.

Since the terminal length from the press-fit section 13 to the contact section 16 of the contact terminal 12 is large and the contact section 16 is connected to the press-fit section via the U-shaped section 15 and since the protrusions 11 of the partition wall 8 enter the gaps 17 between the contact sections 16 and the press-fit sections 13 of the contact terminals 12 to prevent the contact sections 16 from moving toward the press-fit sections 13 and the contact sections 16 are spaced from the terminal leads 14, it is possible to avoid the capillary effects, thereby preventing climbing of flux and solder from the mounting area of the PCB 19, thus providing a stable contact.

The width of the contact section 16 may be equal to that of the U-shaped section 15. In this case, the protrusions 11 may be provided only between the contact section 16 and the press-fit section 13 to prevent climbing of the flux and solder. It is preferred that the protrusions 11 are spaced from the PCB 19 to prevent climbing of the flux and solder from the mounting area.

The extended sides 16A increase the contact area of the contact section 16 so that even if the plug connector is plugged in the receptacle connector 20 offset in the longitudinal direction of the connector body 1, a reliable contact is obtained.

The protrusions 11 may be replaced by only one protrusion provided on either front face 8*a* or rear face 8*b* of the partition wall 8. As shown in FIG. 4, the terminal lead 14 may extend straight from the press-fit section 13 and inserted into and soldered to a through-hole of the PCB 19.

Second Embodiment

Figure 6:
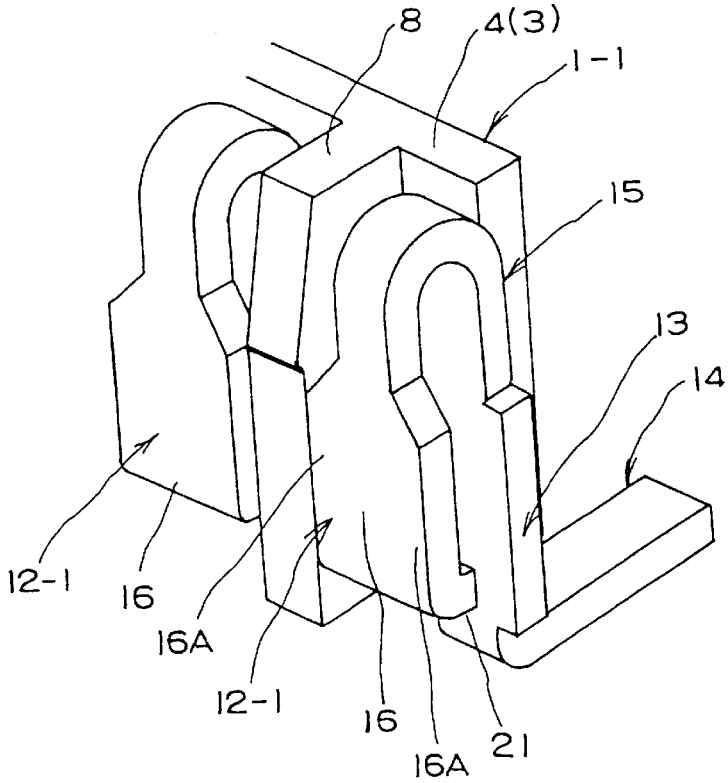
FIG. 6 is a perspective view of contact terminals according to another embodiment of the invention.
Figure 7:
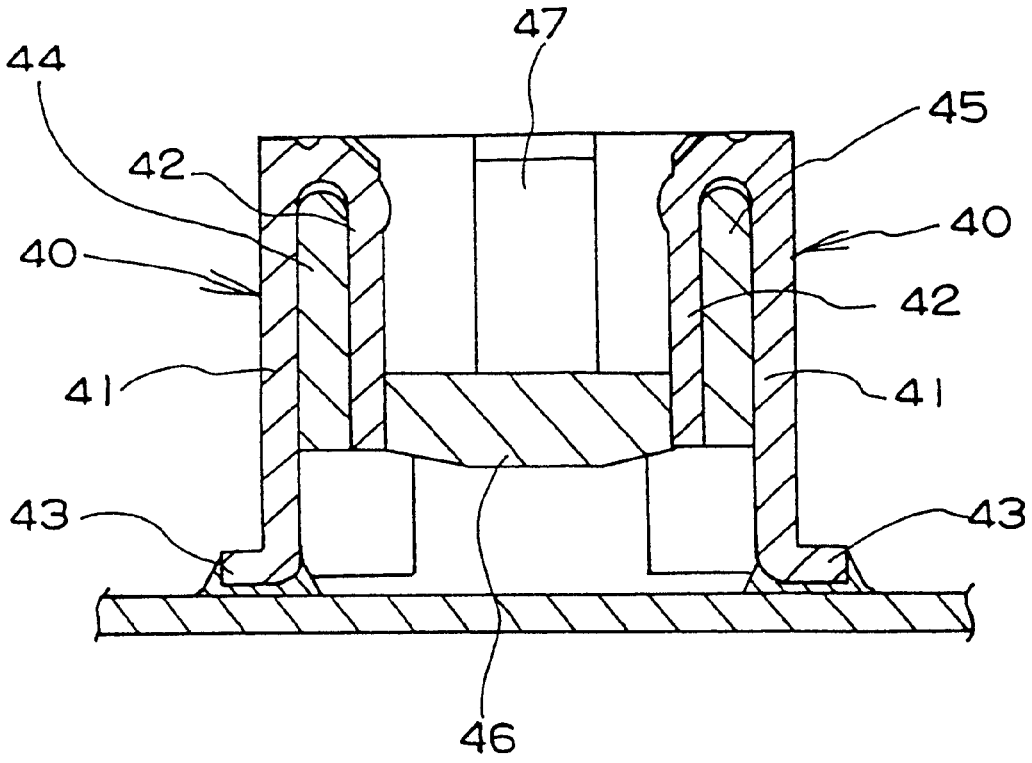
FIG. 7 PRIOR ART
FIG. 7 is a sectional view of a conventional receptacle connector.

The second embodiment of the invention is shown in FIG. 6.

The receptacle connector 20 comprises a connector body 1-1 with a plug cavity 2 having terminal mounting spaces 9 and a plurality of contact terminals 12-1.

The connector body 1-1 is identical with the connector body 1 except for omission of the protrusions 11. The contact terminal 12-1 is identical with the contact terminal 12 except that it is provided with an inward edge 21.

The contact terminals 12-1 are inserted into the terminal mounting spaces of the contact body 1-1 through terminal apertures 10 by press-fitting the press-fit sections into the terminal mounting spaces 9 between partition walls 8 such that the terminal leads 14 project from the terminal apertures 10 and the contact sections 16 face the center of the plug cavity 2.

The receptacle connector 20 is mounted on the PCB 10 by inserting a positioning pin 18 into the positioning hole 19A of the PCB 19 such that the terminal leads 14 of the contact terminals 12-1 are brought into contact with solder cream on the contact pattern of the PCB and the terminal leads 14 are soldered by reflow to the contact pattern.

By plugging a mating plug connector into the receptacle connector 20, it is possible to bring the contact terminals of the plug connector into contact with the contact terminals 12-1 of the receptacle connector 20.

The contact sections 16 of the contact terminals 12-1 are pressed by the contact terminals of the plug connector toward the press-fit sections 13 but hardly able to move toward the press-fit sections because the inward edges 21 abut against the press-fit sections 13.

Since the press-fit section 13 and the contact section 16 of the contact terminal 12 are not exposed from the plug cavity 2, the adjacent contact terminals mounted on the PCB 19 are not short-circuited by a conductive foreign object, such as dirt and dust, attached to the outside of the side walls.

Since the length between the press-fit section 13 and the contact section 16 is large, the contact section is provided with the inward edge 21 to prevent movement of the contact section 16 toward the press-fit section 16, and the contact section is spaced from the side walls 3 and 4, it is possible to avoid the capillary effects, thereby preventing climbing of the flux and solder from the mounting area on the PCB 19, thus providing a stable contact.

The extended sides 16A increase the contact area of the contact section 16 so that even if the plug connector is plugged into the receptacle connector offset in the longitudinal direction of the connector body 1, there is provided a reliable contact condition.

As has been described above, the electrical connector according to the invention has a long terminal length between the fixing or press-fit section and the contact section, with a linking or U-shape section linking the contact section and the press-fit section, and a stopper device for preventing the contact section from moving toward the press-fit section and the terminal lead to thereby prevent the capillary effects and climbing of the flux and solder from the mounting area on the PCB, thus providing a stable contact.

Since the protrusions of the partition wall enter the gap between the contact section and the press-fit section to prevent movement of the contact section toward the press-fit section and keep the contact section from the side walls to prevent the capillary effects and climbing of the flux and solder from the mounting area on the PCB, a stable contact is obtained.

Since the inward edge is provided for the contact section to prevent movement of the contact section toward the press-fit section and keep the contact section from the side walls, thereby preventing the capillary effects and climbing of the flux and solder from the mounting area on the PCB, a stable contact is obtained.

What is claimed is:

1. An electrical connector mounted on a printed circuit board, said electrical connector comprising:

an elongated connector body having a plug cavity with an opening such that a mating connector is inserted into said plug cavity in a direction perpendicular to said printed circuit board, a plurality of partition walls to form a plurality of terminal mounting spaces within said plug cavity with a predetermined pitch in a longitudinal direction of said connector body, and a plurality of protrusions provided on sides of said partition walls;

a plurality of contact terminals, each having a fixing section, a terminal lead extending, at right angles, from one end of said fixing section, a U-shaped section extending from the other end of said fixing section, and a contact section extending downwardly from said U-shaped section such that said contact section is parallel to said fixing section with a gap between said contact and fixing sections and having a pair of extended sides on opposite sides thereof;

said fixing sections being mounted in said terminal mounting spaces such that said terminal leads project from said connector body and said contact sections face a center of said plug cavity, with said extended sides abutting against said protrusions for preventing said contact section from moving toward said fixing section to thereby maintain said gap between said contact and fixing sections to prevent capillary effects from being produced between said fixing and contact sections when said terminal lead is soldered to a surface of said printed circuit board.

2. An electrical connector mounted on a printed circuit board, said electrical connector comprising:

an elongated connector body having a plug cavity with an opening such that a mating connector is inserted into said plug cavity in a direction perpendicular to said printed circuit board, and a plurality of partition walls to form a plurality of terminal mounting spaces within said plug cavity with a predetermined pitch in a longitudinal direction of said connector body; and a plurality of contact terminals, each having a fixing section mounted in said terminal space, a terminal lead extending at right angles from one end of said fixing section and projecting from said terminal body, a U-shaped section extending from the other end of said fixing section, and a contact section extending downwardly from said U-shaped section such that said contact section is parallel to said fixing section with a gap between said contact and fixing sections, facing a center of said plug cavity and having a pair of extended sides on opposite sides thereof and an inward edge extending laterally from said contact section toward said fixing section so that when said mating connector is plugged into said electrical connector, said contact section is prevented from moving toward said fixing section, thus maintaining said gap between said contact and fixing sections to prevent capillary effects from being produced between said contact and fixing sections when said terminal lead is soldered to a surface of said printed circuit board.

* * * * *